US009251705B2

(12) United States Patent
Yoo et al.

(10) Patent No.: US 9,251,705 B2
(45) Date of Patent: Feb. 2, 2016

(54) APPARATUS AND METHOD FOR DETECTING MOVING-OBJECT AROUND VEHICLE

(71) Applicant: Hyundai Motor Company, Seoul (KR)

(72) Inventors: Kyung Ho Yoo, Seoul (KR); Hui Sung Lee, Gyeonggi-do (KR); Hyoung Geun Kwon, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 160 days.

(21) Appl. No.: 13/691,555

(22) Filed: Nov. 30, 2012

(65) Prior Publication Data

US 2013/0325311 A1 Dec. 5, 2013

(30) Foreign Application Priority Data

May 31, 2012 (KR) ..... 10-2012-0058807

(51) Int. Cl.
*G08G 1/16* (2006.01)

(52) U.S. Cl.
CPC . *G08G 1/16* (2013.01); *G08G 1/166* (2013.01)

(58) Field of Classification Search
CPC ..... G08G 1/16; G08G 1/166; G08G 3/02; G08G 5/04; G08G 1/04; G08G 9/02; G08G 1/133; G08G 1/167; G01S 13/931; G01S 17/89; G01S 19/42; B60W 30/095; B60W 2050/146
USPC ..... 701/1, 117, 23, 300, 301, 45, 46; 340/435, 436
See application file for complete search history.

(56) References Cited

U.S. PATENT DOCUMENTS

| | | | | |
|---|---|---|---|---|
| 7,884,705 | B2 * | 2/2011 | Nishimura et al. | 340/436 |
| 2008/0167819 | A1 * | 7/2008 | Breed | 701/300 |
| 2010/0329513 | A1 * | 12/2010 | Klefenz | 382/104 |
| 2011/0123961 | A1 * | 5/2011 | Staplin | 434/64 |
| 2012/0182140 | A1 * | 7/2012 | Kumabe et al. | 340/435 |

FOREIGN PATENT DOCUMENTS

| | | | |
|---|---|---|---|
| JP | 2007-276508 | A | 10/2007 |
| JP | 2010-152580 | A | 7/2010 |
| JP | 2011086205 | A | 4/2011 |
| JP | 2011-175368 | A | 9/2011 |
| KP | 10-2005-0017470 | A | 12/2005 |
| KR | 1019970036088 | A | 12/1995 |
| KR | 101998034003 | A | 12/1998 |
| KR | 1020050117470 | A | 12/2005 |
| KR | 1020080084452 | A | 9/2008 |

* cited by examiner

*Primary Examiner* — Helal A Algahaim
*Assistant Examiner* — Jelani Smith
(74) *Attorney, Agent, or Firm* — Mintz Levin Cohn Ferris Glovsky and Popeo, P.C.; Peter F. Corless

(57) ABSTRACT

An apparatus including a processor configured to: detect a position of a vehicle and a plurality of positions of fixed objects located around the vehicle based on map coordinates; detect objects based on information measured using a distance measurement sensor disposed in the vehicle; detect a moving object among the detected objects; estimate a plurality of positions of the vehicle and the moving object after a fixed period of time based on a position, a speed, and a movement direction of the moving object; and calculate a degree of proximity risk for the moving object with respect to the vehicle based on a distance and a speed between the vehicle and the moving object.

6 Claims, 8 Drawing Sheets

| < MOVING-OBJECT CANDIDATE LIST > |
| --- |
| 1. A ($P_{a1}$ -> $P_{m1}$) |
| 2. B ($P_{a2}$ -> $P_{m2}$) |
| 3. E ($P_{a3}$ -> $P_{m3}$) |
| 4. F ($P_{a4}$ -> $P_{m4}$) |
| 5. G ($P_{a5}$ -> $P_{m5}$) |
| 6. C ($P_{a6}$ -> $P_{m6}$) |
| 7. H ($P_{a7}$ -> $P_{m7}$) |
| 8. D ($P_{a8}$ -> $P_{m8}$) |

Fig. 3

| < SURROUNDING BUILDING LIST > |
| --- |
| 1. A ($P_{LM1}$) |
| 2. B ($P_{LM2}$) |
| 3. C ($P_{LM3}$) |
| 4. D ($P_{LM4}$) |

Fig. 4

| < MOVING-OBJECT LIST > |
| --- |
| 1. E ($P_{m3}$) |
| 2. F ($P_{m4}$) |
| 3. G ($P_{m5}$) |
| 4. H ($P_{m7}$) |

Fig. 5

APPARATUS AND METHOD FOR DETECTING MOVING-OBJECT AROUND VEHICLE

CROSS-REFERENCES TO RELATED APPLICATIONS

This application claims under 35 U.S.C. §119(a) priority to Korean patent application No. 10-2012-0058807 filed on May 31, 2012, the disclosure of which is hereby incorporated in its entirety by reference.

BACKGROUND OF THE INVENTION

1. Field of the Invention

The present invention relates to an apparatus and a method for detecting a moving object around a vehicle, in particular, detecting a moving object around a vehicle using a distance measurement sensor disposed in the vehicle and displaying moving objects other than surrounding fixed objects detected through a global positioning system (GPS) module.

2. Description of the Related Art

Recently, collision preventing systems have been installed in vehicles to better predict a potential collision with another vehicle during driving and to better prevent accidents in advance. Examples of collision preventing systems include a Smart Cruise Control (SMC) system and a Blind Spot Detection (BCS) system.

An example of a collision preventing system includes a system which detects a distance to a preceding vehicle, adjusts an engaging degree of a throttle valve by a cruise controller, and automatically decreases engine speed of the vehicle, thereby preventing collision accidents.

However, the above collision-preventing systems do not allow for user operation to be able to prevent a potential collision when the systems malfunctions.

SUMMARY OF THE INVENTION

The present invention provides an apparatus and a method of detecting moving objects around a vehicle, which provides a driver with collusion prediction information, and may allow the driver to recognize the prediction information to prevent collision accidents. In particular, the present invention provides an apparatus and a method which detect moving objects around a vehicle using a distance measurement sensor disposed in the vehicle and display moving objects other than surrounding fixed objects detected through a GPS module on a display screen, thereby allowing the driver to recognize the moving objects around the vehicle through a navigation screen.

On embodiment of the present invention provides an apparatus and a method of a moving object around a vehicle which display a degree of proximity risk for moving objects with the moving objects around a vehicle on a display screen disposed in the vehicle, and allow a driver to recognize collision probability.

According to an embodiment of the present invention, an apparatus for detecting a moving-object around a vehicle is provided. The apparatus may include a plurality of units executed by a processor within a controller having a memory. The plurality of units may include: a position detection unit which detects a position of a vehicle and positions of fixed objects located around the vehicle based on map coordinates; a moving object detection unit which detects objects based on information measured through a distance measurement sensor disposed in the vehicle, and detects a moving object other than the fixed objects detected by the position detection unit; a position estimation unit which estimates positions of the vehicle and moving object after a fixed period of time based on information for a position, speed, and a movement direction of the moving object; and a proximity risk calculating unit which calculates a degree of proximity risk for the moving object with respect to the vehicle based on information of a distance and speed between the vehicle and the moving object with reference to the estimated positions of the vehicle and moving object estimated by the position estimation unit.

The apparatus may further include an output control unit, executed by the processor, which displays the moving object and the calculated degree of proximity risk corresponding to the moving object on a display screen disposed in the vehicle. The apparatus may further include a coordinate conversion unit, executed by the processor, which converts position information of the detected objects measured by the distance measurement sensor into coordinates on a map.

The moving object detection unit may compare, by the processor, position coordinates of the detected objects and position coordinates of the fixed objects and may exclude the detected objects of which position coordinates are matched with the position coordinates of the fixed objects among the detected objects.

According to another embodiment of the present invention, a method of detecting a moving-object around a vehicle is provided. The method may include: detecting, by a processor, a position of a vehicle and a plurality of positions of fixed objects around the vehicle based on a plurality of map coordinates; detecting, by the processors, objects based on information measured through a distance measurement sensor disposed in the vehicle and detecting a moving object among the detected objects other than fixed objects; estimating, by the processor, a position of the vehicle and a position of the moving object after a fixed period of time based on information for a position, speed, and a movement direction of the moving object; and calculating, by the processor, a degree of proximity risk for the moving object with respect to the vehicle based on information of a distance and speed between the vehicle and the moving object with reference to the estimated positions of the vehicle and moving object.

The method may further include displaying, by the processor, the moving object and the degree of proximity risk calculated corresponding to the moving object on a display screen disposed in the vehicle. The method may further include converting, by the processor, position information of the detected objects into coordinates on a map.

The detecting a moving object may include comparing, by the processor, a plurality of position coordinates of the detected objects with a plurality of position coordinates of the fixed objects and excluding detected objects, of which position coordinates are matched with the position coordinates of the fixed objects.

According to the exemplary embodiment of the present invention, it may be possible to allow a driver to recognize moving objects around a vehicle through a navigation screen while driving a vehicle, by detecting objects around the vehicle using a distance measurement sensor disposed in the vehicle and displaying moving objects on a display screen other than the surrounding fixed objects detected through a GPS module.

In addition, it may be possible to allow the driver to recognize a collision probability to prevent accidents by displaying a degree of proximity risk for the moving objects around the vehicle together with the detected moving objects on the display screen.

BRIEF DESCRIPTION OF THE DRAWINGS

The objects, features and advantages of the present invention will be more apparent from the following detailed description in conjunction with the accompanying drawings, in which

FIGS. 2 to 5 are exemplary views illustrating a moving object detection operation of an apparatus for detecting a moving object around a vehicle according to an exemplary embodiment of the present invention;

DESCRIPTION OF PREFERRED EMBODIMENTS

Figure 1:
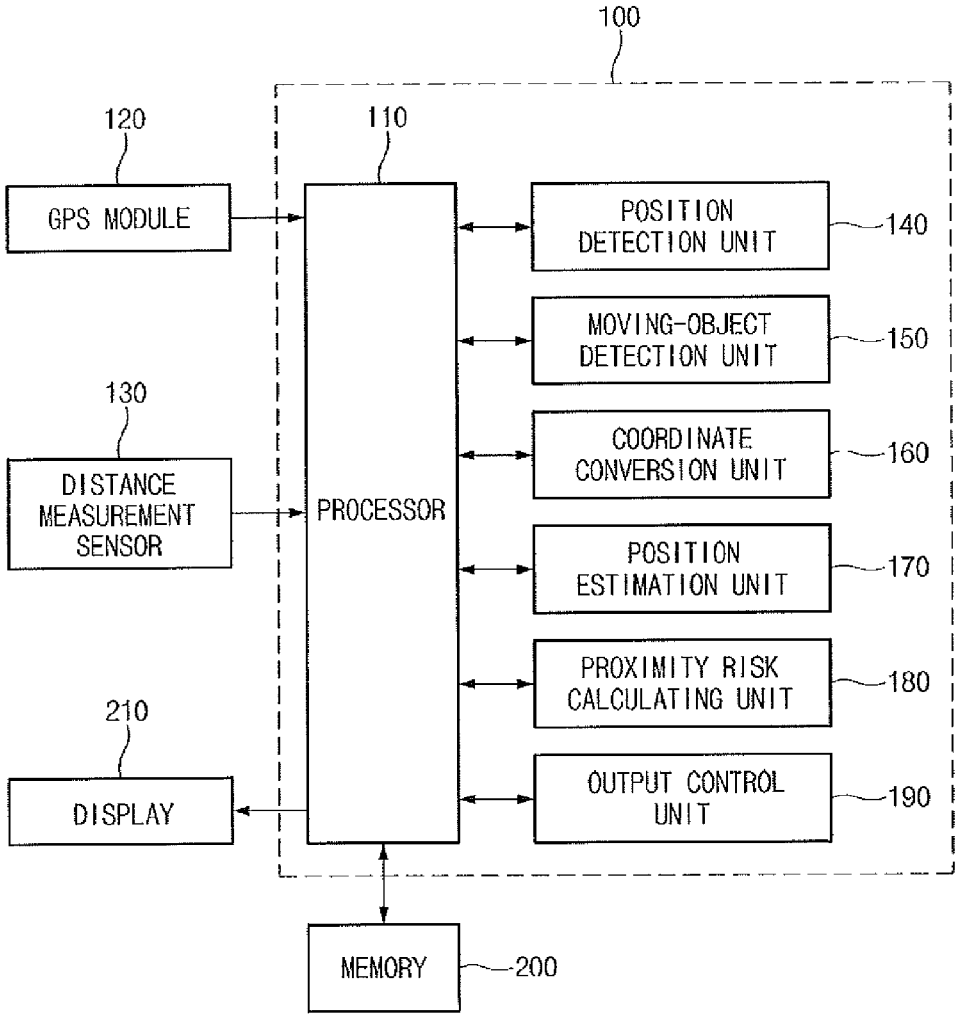
FIG. 1 is an exemplary block diagram illustrating a configuration of an apparatus for detecting a moving object around a vehicle according to an exemplary embodiment of the present invention.

Reference will now be made in detail to various embodiments of the present invention(s), examples of which are illustrated in the accompanying drawings and described below. Like reference numerals in the drawings denote like elements. When it is determined that detailed description of a configuration or a function in the related disclosure interrupts understandings of embodiments in description of the embodiments of the invention, the detailed description will be omitted.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). As referred to herein, a hybrid vehicle is a vehicle that has two or more sources of power, for example both gasoline-powered and electric-powered vehicles.

Although exemplary embodiment is described as using a plurality of units to perform the exemplary process, it is understood that the exemplary processes may also be performed by one or plurality of modules. Additionally, it is understood that the term controller refers to a hardware device that includes a memory and a processor. The memory is configured to store the modules and the processor is specifically configured to execute said modules to perform one or more processes which are described further below.

Furthermore, the control logic of the present invention may be embodied as non-transitory computer readable media on a computer readable medium containing executable program instructions executed by a processor, controller or the like. Examples of the computer readable mediums include, but are not limited to, ROM, RAM, compact disc (CD)-ROMs, magnetic tapes, floppy disks, flash drives, smart cards and optical data storage devices. The computer readable recording medium can also be distributed in network coupled computer systems so that the computer readable media is stored and executed in a distributed fashion, e.g., by a telematics server or a Controller Area Network (CAN).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

An object of a apparatus and a method for detecting a moving object around a vehicle is to provide technology which allows a driver to recognize movements of moving objects around a vehicle through a display screen by detecting the moving objects around the vehicle based on information obtained through a satellite navigation system and information measured through a distance measurement sensor disposed in the vehicle, calculating a degree of proximity risk of the detected moving objects, and displaying the calculated result together with the detected moving-objects on the display screen.

Herein, the satellite navigation system may include a global positioning system (GPS). However, in addition to the GPS, a satellite navigation system such as global navigation satellite system (GNSS) may be used.

FIG. 1 is an exemplary block diagram illustrating a configuration of an apparatus for detecting a moving object around a vehicle according to an exemplary embodiment of the present invention.

Referring to FIG. 1, an apparatus for detecting a moving object around a vehicle (hereinafter, referred to as a moving object detection apparatus) may include a GPS module 120, a distance measurement sensor 130, a display 210, and a plurality of units executed by a processor 110 within a controller 100 including a memory 200. The plurality of units may include: a position detection unit 140, a moving object detection unit 150, a coordinate conversion unit 160, a position estimation unit 170, a proximity risk calculating unit 180, and an output control unit 190. The processor 110 controls an operation of the respective units of the moving object detection apparatus.

The GPS module 120 may obtain position information of a vehicle and then obtain position information of a plurality of fixed objects (e.g., buildings) located around the vehicle, with respect to GPS coordinates using a satellite navigation system. However, other types of satellite navigation systems such as the GNSS may be used.

The distance measurement sensor 130 may be installed in a front of the vehicle. The distance measurement sensor 130 may emit a signal ahead of the vehicle and may receive a plurality of reflected signals to detect objects ahead or around the vehicle. Here, as the distance measurement sensor 130, a radar, a lidar, and an ultrasonic sensor, and the like may be used.

The position detection unit 140 may detect, by a processor, a position of the vehicle and a plurality of position corresponding to the plurality of fixed objects around the vehicle based on position information of the vehicle and fixed objects obtained through the GPS module 120.

The moving-object detection unit 150 may detect, by the processor, objects based on information measured through the distance measurement sensor 130 disposed in the vehicle. In particular, the detected objects may include buildings, vehicles, motorcycles, and pedestrians, and the like located around the vehicle. Furthermore, the moving-object detection unit 150 may detect, by the processor, position information of the detected objects, that is, a plurality of relative coordinates with reference to the position of the vehicle.

The coordinate conversion unit 160 may convert, by the processor, the position information of the detected objects from the relative coordinates with reference to the vehicle to coordinates on a map.

The moving-object detection unit 150 may compare, by the processor, the converted position coordinates of the detected objects and position coordinates of the fixed objects detected by the position detection unit 140. The objects of the detected objects, which may correspond to the position coordinates of the fixed objects, may be excluded from the detected objects. In other words, the moving object detection unit 150 compares, by the processor, the GPS coordinates of the detected objects with the GPS coordinates of the fixed objects detected by the GPS module 120 and may exclude detected objects having corresponding GPS coordinates to the GPS coordinates of the fixed objects.

Moreover, when the error between the converted position coordinates of the detected objects and the position coordinates of the fixed objects is within a reference value $\epsilon$, the moving object detection unit 150 may determine, by the processor, the corresponding detected objects as the fixed object. As one example, when the converted position coordinate of the moving object is $P_{mi}=\{x_i, y_i\}$, (i=1, . . . , N) and the position coordinate of the fixed object measured by the GPS module 120 is $P_{Lmj}=\{x_j, y_j\}$, (j=1, . . . , M), the moving object detection unit 150 may determine the corresponding moving object as the fixed-object when norm $[P_{LMj}-P_{mi}]<\epsilon$.

Thus, the moving object detection unit 150 may detect, by the processor, the detected objects other than the fixed objects as the moving-objects.

The position estimation unit 170 may estimate, by the processor, a plurality of positions, speeds and movement directions of the moving objects detected by the moving object detection unit 150. Furthermore, the position estimation unit 170 may estimate the positions and speeds of the moving objects through a probabilistic model based estimation method, for example, a kalman filter, a particle filter, or the like. Alternatively, the position estimation unit 170 may estimate the position, speed, movement direction of each moving object based on a change in the position coordinates of the moving objects.

In addition, the position estimation unit 170 may estimate, by the processor, a plurality of positions corresponding to the moving objects after a fixed period of time based on information for the estimated positions and speeds of the moving objects. The equation for estimating the position of the moving object after the fixed period of time may as follows:

$$P_{est_mov}(k)=P_{mov}(k)+V_{mov}(k)\cdot\Delta t \quad \text{[Mathematical Equation 1].}$$

Wherein, $P_{est_mov}(k)$ is an estimated position of the moving object after a fixed period of time, $P_{mov}(k)$ is an estimated position of the moving object which is moving, and $V_{mov}(k)$ is an estimated speed of the moving object which is moving.

Additionally, the position estimation unit 170 may estimate, by the processor, the position of the vehicle after the fixed period of time. The equation for estimating the position of the vehicle after the fixed period of time is as follows:

$$P_{est_ego}=P_{ego}+V_{ego}\cdot\Delta t \quad \text{[Mathematical Equation 2]}$$

Wherein, $P_{est_ego}$ is an estimated position of the vehicle after the fixed period of time, $P_{ego}$ is an estimated position of the vehicle which is moving, and $V_{ego}$ is an estimated speed of the vehicle which is moving.

Using the above equations, when the estimated positions of the moving-object and the vehicle after a fixed period of time are calculated, the proximity risk calculating unit 180 may compare, by the processor, the estimated positions of the moving object and the vehicle after the fixed period of time to calculate a degree of proximity risk of the moving object with respect to the vehicle.

Furthermore, the proximity risk calculating unit 180 may apply, by the processor, an error range to the estimated positions of the moving object and the vehicle after the fixed period of time and may determine the moving object as a moving object having a high degree of proximity risk when the distance between the moving object and the vehicle after the fixed period of time is less than the error range. Moreover, the proximity risk calculating unit 180 may determine, by the processor, the moving object as a moving-object having an intermediate degree of proximity risk when the distance between the moving object and the vehicle after the fixed period of time is equal to the error range. The proximity risk calculating unit 180 may determine, by the processor, the moving-object as a moving object having a low degree of proximity risk when the distance between the moving object and the vehicle after the fixed period of time is greater than the error range.

As one example, under the assumption that the error range for the estimated position of the moving object after the fixed period of time is r, the error range for the estimated position of the vehicle after the fixed period of time is R, and a distance between the moving object and the vehicle after the fixed period of time is d, the proximity risk calculating unit 180 may determine, by the processor, that the degree of proximity risk of the moving object with respect to the vehicle is high when R+r>d. Similarly, the proximity risk calculating unit 180 may determine that the degree of proximity risk of the moving object with respect the vehicle is intermediate when R+r=d, and may determine that the degree of proximity risk of the moving object with respect to the vehicle is low when R+r<d.

The output control unit 190 may display on a display screen, by the processor, the moving object of which a position is estimated by the position estimation unit 170. In addition, when displaying the moving object on the display screen, the output control unit 190 may also display the estimated position of the moving object after the fixed period of time. Furthermore, the output control unit 190 may display the degree of proximity risk calculated corresponding to the position estimated moving object together with the moving object. Specifically, the degree of proximity risk may be illustrated on the display by a variety of shapes, sizes, colors and, emoticons, and the like. on the moving object.

The processor may store a plurality of set-up values for operating the moving object detection apparatus and the position information of the vehicle and the detected moving objects on the memory 200. In addition, the processor 110 may store on the memory 200 the coordinate information converted by the coordinate conversion unit 160, the estimated positions of the moving object and vehicle, and the degree of proximity risk calculated corresponding to each moving object.

The display 210 may display the position, the degree of proximity risk, and the like for the moving object according to a control command from the output control unit 190, executed by the processor 110. In particular, the display 210 may include a monitor, a navigation screen, or the like disposed in the vehicle.

FIGS. 2 to 5 are exemplary views illustrating a moving object detection operation of an apparatus for detecting a moving-object around a vehicle according to an exemplary embodiment of the present invention.

Figure 2:
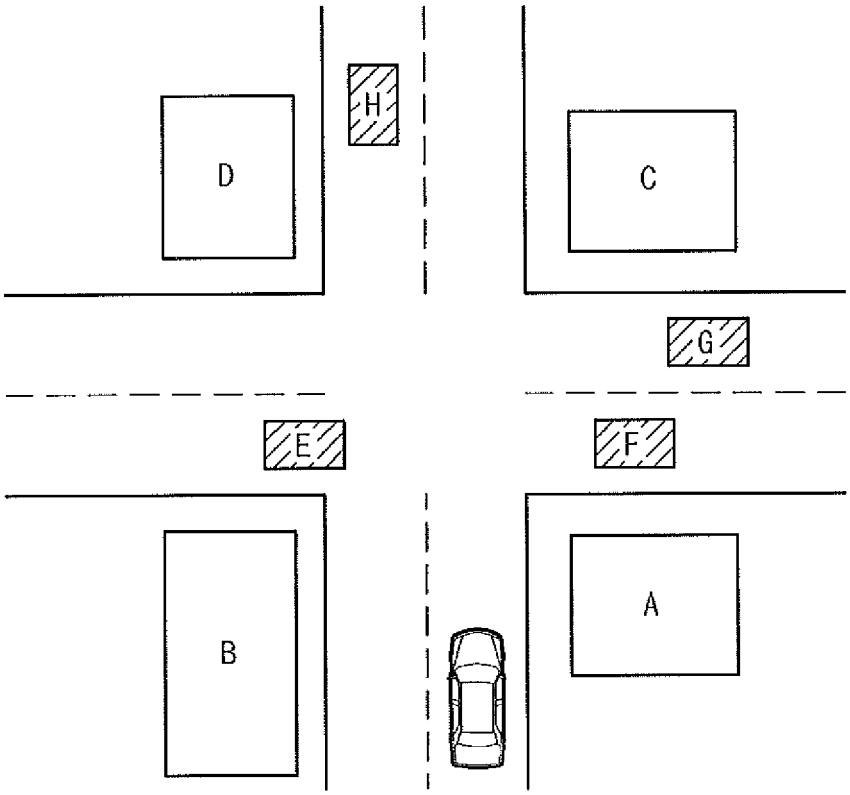

First, FIG. 2 shows the detected objects around the vehicle according to the invention. As shown in FIG. 2, buildings, vehicles, and the like may be located around the vehicle. The moving object detection apparatus may detect, by the processor, the objects, which are measured by the distance measurement sensor disposed in the vehicle, as the detected objects. In other words, when a building A, a building B, a building C, a building D, a vehicle E, a vehicle F, a vehicle G, and a vehicle H are located around the vehicle, the distance measurement sensor disposed in the vehicle may emit a laser, a ultrasonic wave, or the like and receive signals reflected from the building A, the building B, the building C, the building D, the vehicle E, the vehicle F, the vehicle G, the vehicle H located around the vehicle.

Accordingly, the moving-object detection apparatus may detect, by the processor, objects through the received signals of the distance measurement sensor which are reflected from the building A, the building B, the building C, the building D, the vehicle E, the vehicle F, the vehicle G, the vehicle H located around the vehicle. In particular, the moving object detection apparatus may detect, by the processor, position information of each detected object based on the signals received through the distance measurement sensor. The position information of each detected object may be a relative coordinate with reference to the position of the vehicle.

Furthermore, the moving object detection apparatus may generate, by the processor, a detected object list for the objects detected by the distance measurement sensor. FIG. 3 shows an example of the moving-object candidate list according to an exemplary embodiment of the present invention.

As illustrated in FIG. 3, the moving object detection apparatus may create, by the processor, the detected object list as "1.A, 2.B, 3.E, 4.F, 5.G, 6.C, 7.H, 8.D" based on the received signals reflected from the building A, the building B, the building C, the building D, the vehicle E, the vehicle F, the vehicle G, and the vehicle H. When creating the detected object list, the moving object detection apparatus may create position information corresponding to each of the detected objects of the detected object list.

Furthermore, the moving object detection apparatus may convert, by the processor, the relative coordinates corresponding to the detected objects to the map coordinates and may reflect the conversion result to the detected object list.

As one example, when the relative coordinates of the detected objects A, B, E, F, G, C, H, an D are $P_{a1}$, $P_{a2}$, $P_{a3}$, $P_{a4}$, $P_{a5}$, $P_{a6}$, $P_{a7}$, and $P_{a8}$, the moving object detection apparatus may convert the relative coordinates of the detected objects into the map coordinates as $P_{a1} \rightarrow P_{m1}$, $P_{a2} \rightarrow P_{m2}$, $P_{a3} \rightarrow P_{m3}$, $P_{a4} \rightarrow P_{m4}$, $P_{a5} \rightarrow P_{m5}$, $P_{a6} \rightarrow P_{m6}$, $P_{a7} \rightarrow P_{m7}$ and $P_{a8} \rightarrow P_{m8}$, and then may reflect the converted coordinates to the detected object list.

Moreover, the moving-object detection apparatus may create, by the processor, a surrounding building list based on the information of surrounding buildings detected by the position detection unit. FIG. 4 shows an example of the surrounding building list according to an exemplary embodiment of the present invention.

As shown in FIG. 4, the surrounding buildings around the vehicle, which may be detected by the GPS module, are listed as A, B, C and D. Thus, the moving object detection apparatus may create the surrounding building list as "1.A, 2.B, 3.C, 4.D," Furthermore, the moving objection detection apparatus may create position information corresponding to the surrounding buildings on the surrounding building list. As an example, the moving objection detection apparatus may reflect, by the processor, position coordinates $P_{LM1}$, $P_{LM2}$, $P_{LM3}$ and $P_{LM4}$ corresponding to the surrounding buildings A, B, C and D to the surrounding building list.

The moving object detection unit may compare, by the processor, the detected object list of FIG. 3 and the surrounding building list of FIG. 4 and may exclude detected objects which correspond with the surrounding buildings, from the detected object list. In other words, among the detected objects, A, B, E, F, G, C, H and D, the moving objection detection apparatus may exclude the detected objects A, B, C, and D, which are surrounding buildings, from the detected object list and may create the moving object list for the remaining detected objects. FIG. 5 illustrates an example of a detected object list according to an exemplary embodiment of the present invention.

As shown in FIG. 5, the moving object list includes the remaining detected objects, that is, E, F, G and H other than the fixed-objects corresponding to the surrounding buildings among the detected objects. Furthermore, the moving object list may include the moving objects E, F, G, and H and position information $P_{m3}$, $P_{m4}$, $P_{m5}$, and $P_{m7}$ corresponding to the moving objects.

Figure 6:
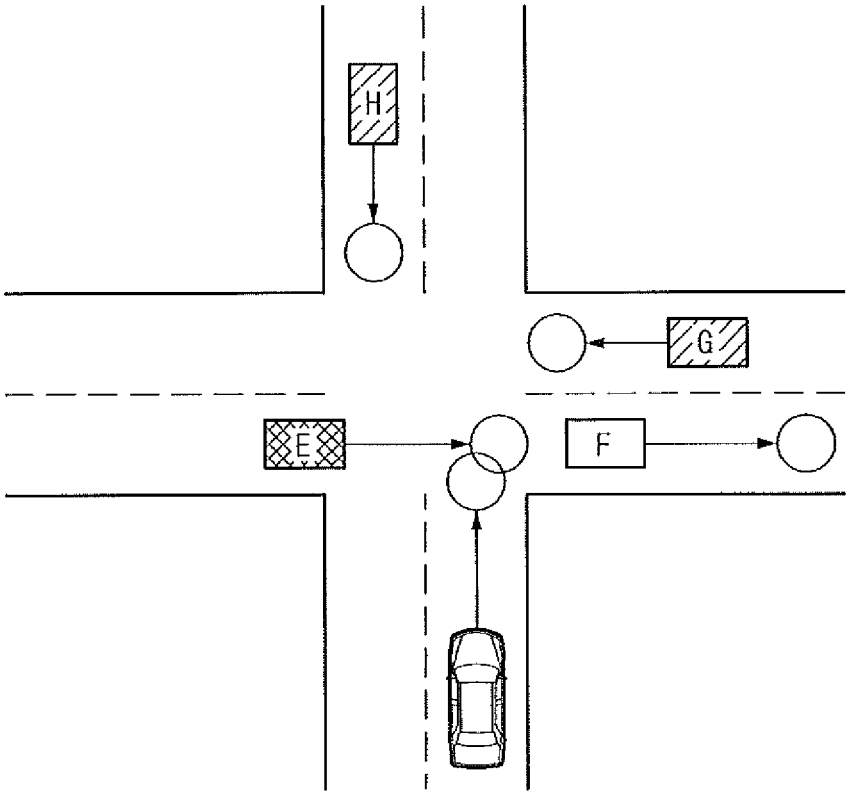
FIG. 6 is an exemplary view illustrating a moving object display operation of an apparatus for detecting a moving object around a vehicle according to an exemplary embodiment of the present invention.

FIG. 6 is an exemplary view illustrating a moving object display operation of an apparatus for detecting a moving-object around a vehicle according to an exemplary embodiment of the present invention.

When the moving object list is completed as shown in FIG. 5, the moving objection detection apparatus may predict, by the processor, a position, a speed, a movement direction, and the like of each of the moving objects included in the moving object list, and may estimate the positions of the moving objects and the vehicle after a fixed period of time. Furthermore, the moving object detection apparatus may calculate the degree of proximity risk by comparing the position of each of the moving objects with the position of the vehicle and the degree of proximity risk may be displayed on the display screen together with the positions of the moving objects.

Referring to FIG. 6, the moving object detection apparatus may display current positions of the vehicle and the moving objects E, F, G and H on a navigation screen together with estimated positions of the moving objects E, F, G and H and the vehicle after the fixed period of time.

When a moving object with a high degree of proximity risk is present with reference to the estimated position of the vehicle after the fixed period of time, the moving object detection apparatus may display the degree of proximity risk together with the position information on the display.

For example, since a distance between the estimated position of the vehicle and the estimated position of the moving object E after the fixed period of time is below a reference value, the moving object E may be displayed to have a high degree of proximity risk. In addition, since distances between the estimated positions of the moving objects H and G and the estimated position of the vehicle after the fixed period of time are approximately the reference value, the moving-objects H and G may be displayed to have a normal degree of proximity risk. Moreover, since a distance between the estimated positions of vehicle and moving object F after the fixed period of time is greater than the reference value, the moving object F may be displayed to have a low degree of proximity risk.

Figure 7:
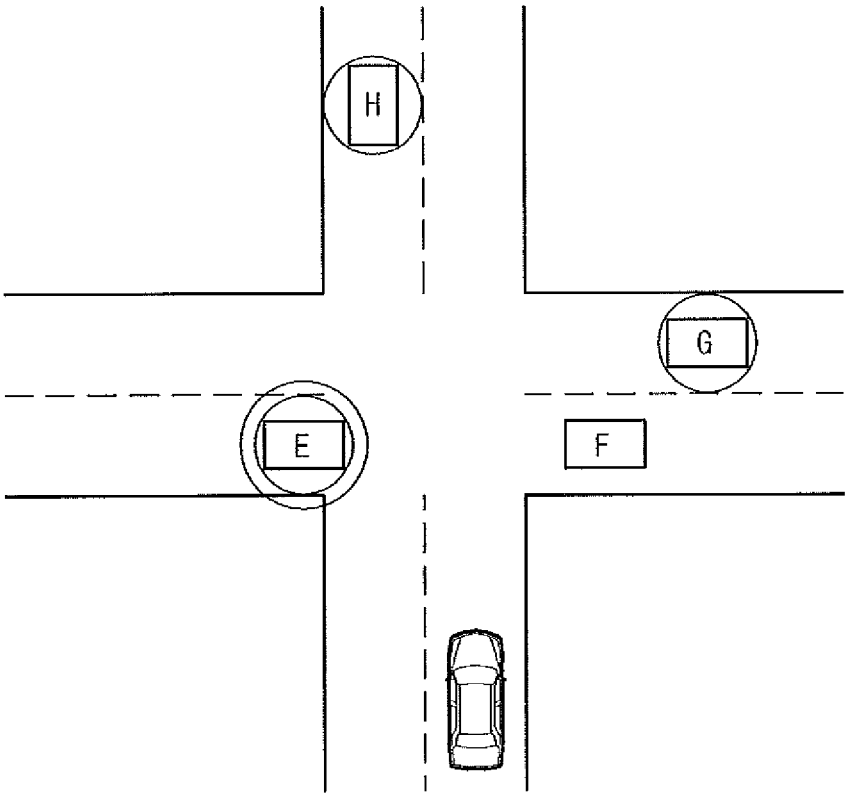
FIG. 7 is an exemplary view illustrating a moving object display operation of an apparatus for detecting a moving object around a vehicle according to another exemplary embodiment of the present invention.

FIG. 7 is an exemplary view illustrating a moving object display operation according to another exemplary embodiment of the present invention. Although FIG. 6 illustrates the moving objects displayed with different shapes according to the degree of proximity risk, FIG. 7 illustrates an example in which the degree of proximity risk may be displayed around the vehicles which are the moving objects.

As shown in FIG. 7, a moving object F having a low degree of proximity risk is illustrated without a surrounding mark and a single circle is illustrated around the moving objects G and H having a normal degree of proximity. Additionally, two circles are illustrated around the moving object E having a high degree of proximity risk. Thereby, the driver may recognize the moving object E having the high degree of proximity risk.

The examples of FIGS. 6 and 7 are merely illustrative and thus various examples of displaying the degree of proximity risk for each moving-object differently using a color, a shadow, a thickness of a line, an emoticon, or the like may be applied.

Hereinafter, an operation procedure of an apparatus for detecting a moving object around a vehicle having the above configuration according to an exemplary embodiment of the present invention will be described in detail.

Figure 8:
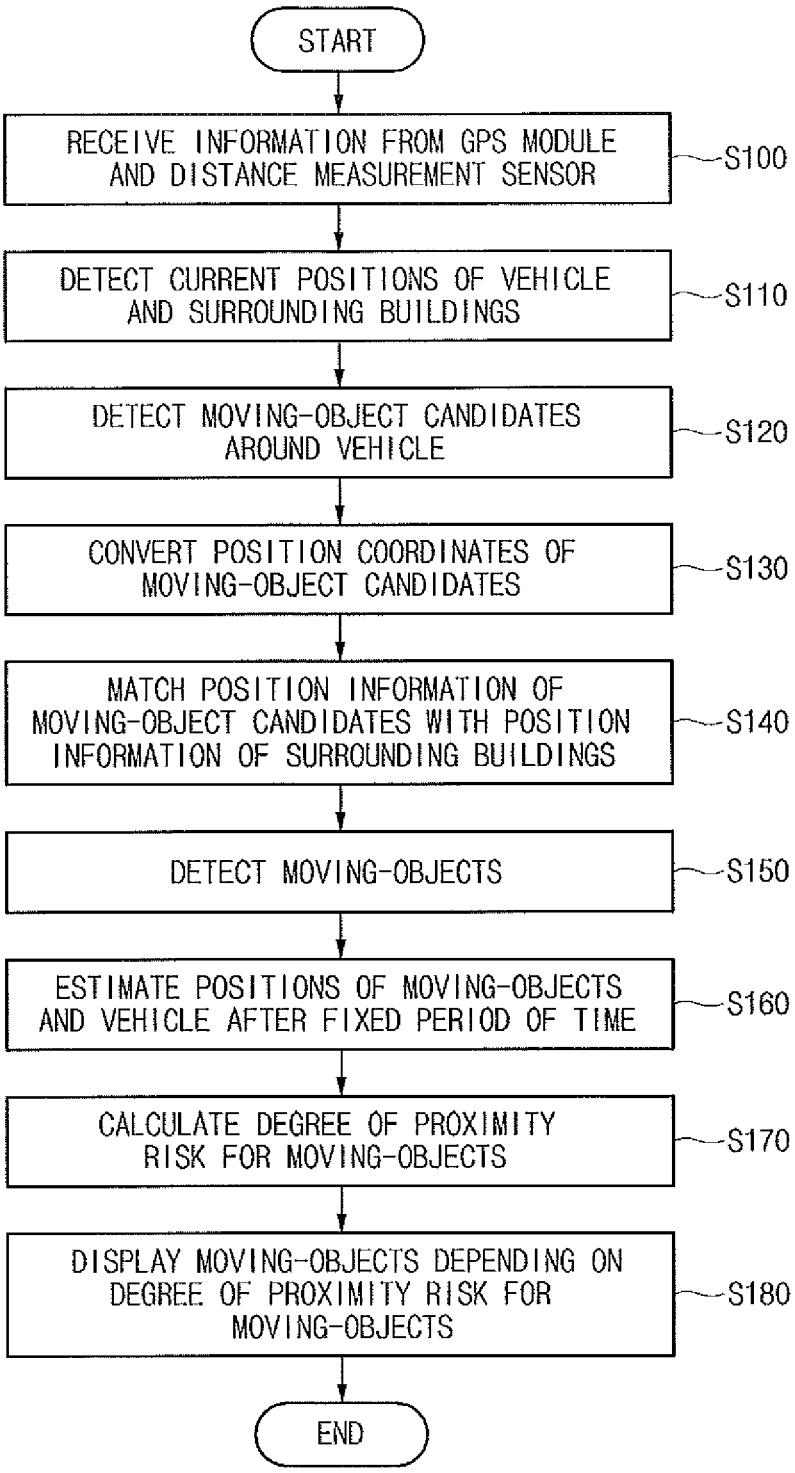
FIG. 8 is an exemplary flow chart illustrating an operation procedure for a method of detecting a moving object around a vehicle according to an exemplary embodiment of the present invention.

FIG. 8 is an exemplary flow chart illustrating a method of detecting a moving object around a vehicle according to an exemplary embodiment of the present invention.

Referring to FIG. 8, the moving object detection apparatus receives, by a processor, information from a GPS module and from a distance measurement sensor to detect moving objects around a vehicle (S100). A satellite navigation system such as GNSS, or the like, may also be used for the position information.

The moving object detection apparatus may detect, by a processor, current position of the vehicle and positions of surrounding buildings based on the information measured by the GPS module (S110). In addition, the moving object detection apparatus may detect, by the processor, objects around the vehicle based on the information measured from the distance measurement sensor (S120). In particular, the moving object detection apparatus detects position information of the objects detected in step S120, in other words, relative coordinates with reference to the current position of the vehicle. Moreover, the moving object detection apparatus may convert, by the processor, the position coordinates of the detected objects (S130). More specifically, in step S130, the moving object detection apparatus may convert relative coordinates of the detected objects with reference to the position of the vehicle into map coordinates.

Moreover, the moving object detection apparatus may match, by the processor, the position information of the detected objects with the position information of the surrounding buildings detected in step S110 (S140) to finally detect the moving objects (S150). When detecting the moving objects in step S150, the moving object detection apparatus may exclude, by the processor, detected objects which correspond to or match the position information of the surrounding buildings among the detected objects, and may detect the remaining detected objects as the moving objects.

When the moving objects are detected by the processor in step S150, the moving-objection detection apparatus may estimate, by the processor, the positions of the moving objects after a fixed period of time based on positions, speed, and movement directions of the moving objects, and may additionally estimate the position of the vehicle after the fixed period of time based on the current position, speed, and movement direction of the vehicle (S160).

The moving object detection apparatus may calculate, by the processor, a degree of proximity risk of the moving objects with respect to the vehicle based on the estimated positions of the moving objects and the vehicle after the fixed period of time estimated in step S160 (S170). The degree of the proximity risk of the moving-object is determined to be high when a distance between the estimated positions of the vehicle and the moving objects after the fixed period of time is smaller than a total value of error ranges for the estimated positions of the vehicle and the moving objects, normal when the distance the distance between the estimated positions is equal to the total value of the error ranges, and low when the distance between the estimated positions is larger than the total value of the error ranges.

The moving object detection apparatus may display the positions of the vehicle and the moving objects on the display. Furthermore, the moving object detection apparatus may display the moving objects according to the degree of proximity risk calculated in step S170 (S180).

The foregoing descriptions of exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain exemplary principles of the invention and their practical application, to thereby enable others skilled in the art to make and utilize various exemplary embodiments of the present invention, as well as various alternatives and modifications thereof. It is intended that the scope of the invention be defined by the accompanying Claims and their equivalents.

What is claimed is:

1. An apparatus for detecting a moving object around a vehicle, the apparatus comprising:

a processor configured to:

detect a position of a vehicle and a plurality of positions of fixed-objects located around the vehicle based on map coordinates using a global positioning system (GPS);

detect a plurality of objects based on information measured using a distance measurement sensor disposed in the vehicle;

detect moving objects among the plurality of detected objects;

generate a detected object list detected by the distance measurement sensor;

remove fixed-objects detected by the GPS from the detected object list;

detect remaining objects on the detected object list as moving objects;

convert position information of the plurality of detected objects measured by the distance measurement sensor from relative coordinates based on the vehicle position into a plurality of map coordinates;

estimate a plurality of positions of the vehicle and the moving objects after a fixed period of time based on a position, a speed, and a movement direction of the moving objects;

calculate a degree of proximity risk of the moving objects with respect to the vehicle based on a distance and a speed between the vehicle and the moving objects; and display the moving objects and the calculated degree of proximity risk corresponding to the moving objects on a display screen disposed in the vehicle, wherein a shape of each moving object is displayed differently based on the degree of proximity risk or the degree of proximity risk is displayed around each moving object, in order for a driver to recognize the moving object having a high degree of proximity risk.

2. The apparatus of claim 1, wherein the processor is further configured to:

compare a plurality of position coordinates of detected objects with a plurality of position coordinates of the fixed objects; and exclude detected objects including position coordinates corresponding the plurality of position coordinates of the fixed objects.

3. A method of detecting a moving object around a vehicle, the method comprising:

detecting, by a processor, a position of a vehicle and a plurality of positions of a plurality of fixed objects around the vehicle based on map coordinates using a global positioning system (GPS);

detecting, by the processor a plurality of objects based on information measured using a distance measurement sensor disposed in the vehicle;

detecting, by the processor, moving objects among the plurality of detected objects;

generating, by the processor, a detected object list detected by the distances measurement sensor;

removing, by the processor, fixed-objects detected by the GPS from the detected object list;

detecting, by the processor, remaining objects on the detected object list as moving objects;

converting, by the processor, position information of the plurality of detected objects measured by the distance measurement sensor from relative coordinates based on the vehicle position into a plurality of map coordinates;

estimating, by the processor, a plurality of positions of the vehicle and the moving objects after a fixed period of time based a position, a speed, and a movement direction of the moving objects, in order for a driver to recognize the moving object having a high degree of proximity risk;

calculating, by the processor, a degree of proximity risk of the moving objects with respect to the vehicle based on a distance and a speed between the vehicle and the moving objects; and displaying, by the processor, the moving objects and the calculated degree of proximity risk corresponding to the moving objects on a display screen disposed in the vehicle, wherein a shape of each moving object is displayed differently based on the degree of proximity risk or the degree of proximity risk is displayed around each moving object.

4. The method of claim 3, wherein the detecting a moving object further includes:

comparing, by the processor, a plurality of position coordinates of detected objects with a plurality of position coordinates of the fixed objects; and excluding, by the processor, detected objects including position coordinates corresponding to the plurality of position coordinates of the fixed objects.

5. A non-transitory computer readable medium containing program instructions executed by a processor, the computer readable medium comprising:

program instructions that detect a position of a vehicle and a plurality of positions of fixed-objects located around the vehicle based on map coordinates using a global positioning system (GPS);

program instructions that detect a plurality of objects based on information measured using a distance measurement sensor disposed in the vehicle;

program instructions that detect moving objects among the plurality of detected objects;

program instructions that generate a detected object list detected by the distance measurement sensor;

program instructions that exclude fixed-objects detected by the GPS from the detected object list;

program instructions that detect remaining objects on the detected object list as moving objects;

program instructions that convert position information of the plurality of detected objects measured by the distance measurement sensor from relative coordinates based on the vehicle position into a plurality of map coordinates;

program instructions that estimate a plurality of positions of the vehicle and the moving objects after a fixed period of time based on a position, a speed, and a movement direction of the moving objects;

program instructions that calculate a degree of proximity risk of the moving objects with respect to the vehicle based on a distance and a speed between the vehicle and the moving objects; and program instructions that display the moving objects and the calculated degree of proximity risk corresponding to the moving objects on a display screen disposed in the vehicle, wherein a shape of each moving object is displayed differently based on the degree of proximity risk or the degree of proximity risk is displayed around each moving object, in order for a driver to recognize the moving object having a high degree of proximity risk.

6. The computer readable medium of claim 5, further comprising:

program instructions that compare a plurality of position coordinates of detected objects with a plurality of position coordinates of the fixed objects; and program instructions that exclude detected objects including position coordinates corresponding the plurality of position coordinates of the fixed objects.

* * * * *